US008936059B2

(12) United States Patent
Dehne

(10) Patent No.: US 8,936,059 B2
(45) Date of Patent: Jan. 20, 2015

(54) CRAFT BEAD ROLLER

(76) Inventor: Vicki L. Dehne, Bel Air, MD (US)

( * ) Notice: Subject to any disclaimer, the term of this patent is extended or adjusted under 35 U.S.C. 154(b) by 860 days.

(21) Appl. No.: 13/181,696

(22) Filed: Jul. 13, 2011

(65) Prior Publication Data

US 2013/0014554 A1 Jan. 17, 2013

(51) Int. Cl.
*B21D 15/04* (2006.01)
*A44C 27/00* (2006.01)
*A44C 11/00* (2006.01)

(52) U.S. Cl.
CPC ..... *A44C 27/00* (2013.01); *A44C 11/002* (2013.01)
USPC ..... 156/450; 72/105

(58) Field of Classification Search
CPC ..... A44C 11/002; A44C 27/00
USPC ..... 156/450; 72/105
See application file for complete search history.

(56) References Cited

U.S. PATENT DOCUMENTS 4,575,890 A * 3/1986 Hidle ..... 15/104.002

* cited by examiner

*Primary Examiner* — Philip Tucker
*Assistant Examiner* — Vicki Wu
(74) *Attorney, Agent, or Firm* — Jordan IP Law, LLC; Todd A. Vaughn

(57) ABSTRACT

A bead roller is provided for manually crafting a bead from a strip of material. The bead roller may include a handle guide carrier, a first handle portion mounted for rotational movement on the handle guide carrier; a second handle portion mounted for rotational and longitudinal movement on the handle guide carrier; and a tool arm axially extending from the second handle portion and having first and second spaced apart opposing edges which define a slot which receives and engages a distal end of the strip of material. The second handle portion is configured for rotation simultaneously with the tool arm about the handle guide carrier and independently of the first handle portion.

20 Claims, 5 Drawing Sheets

CRAFT BEAD ROLLER

BACKGROUND OF THE INVENTION

Beading is a type of craft activity involving, for example, the creation of decorative articles such as jewelry, purses, baskets, wall hangings, etc. using one or more decorative objects called beads. The beads may be composed of various materials such as ceramics, polymers, stone, resins, paper and the like that have a circular or semi-circular cross-section with a hole located in the center thereof and inserting a length of thread or wire through the hole.

During a process of creating one or more beads, a paper and/or composite material is cut into streams or strips of various lengths, each strip having a specific geometric shape. Each individual strip may then be wound into a bead having a circular or semi-circular geometric shape. Depending on the length of the material strip and/or the intended decorative article to be created, each bead may range in size from several centimeters to several centimeters in diameter.

SUMMARY OF THE INVENTION

Embodiments are related to an apparatus that effectively permits the manual crafting of beads in an efficient fashion.

Embodiments are related to an apparatus for manually crafting beads that provides a user thereof an ability to create several decorative articles in a reduced length of time.

Embodiments are related to an apparatus for manually crafting beads which has an enhanced ergonomic design that significantly reduces undue stress and/or cramping of the hands and fingers of a user.

Embodiments are related to an apparatus for manually crafting beads of uniform diameter, thereby producing a decorative article of professional quality.

Embodiments are related to an apparatus for manually crafting beads that permits the manual ejection of completed beads.

In accordance with embodiments, a bead roller is provided and adapted to craft a bead from a strip of material, the bead roller including at least one of the following: a handle having a gripping surface configured for engagement by a hand of a user, the handle including a first handle portion; and a second handle portion axially extending from the first handle portion; a tool arm axially extending from the second handle portion and having first and second edges spaced apart a predetermined distance to define a slot which receives and engages a distal end of the strip of material; and a handle guide carrier onto which the first and second handle portions are mounted for longitudinal and rotational movement. During a beading sequence of crafting the bead, the first handle portion is configured for rotation about the handle guide carrier simultaneously with the tool arm while the second handle portion is in a non-rotatable position to thereby wound the strip of material about the tool arm and also configured for longitudinal movement along the handle guide carrier to eject the bead from the tool arm.

In accordance with embodiments, an apparatus for making a bead from a strip of material may include at least one of the following: a handle having a gripping surface which is engaged by a user when crafting the bead, the handle including a first handle portion having a first diameter, and a second handle portion axially extending from the first handle portion, the second handle having a first section with a second diameter which is less than the first diameter and a second section with a third diameter which is equal to the first diameter, the second handle portion also being rotatable in clockwise and counterclockwise directions relative to the first handle portion; a tool arm axially extending from the first section of the second handle portion and configured for simultaneous rotation with the second handle portion, the tool arm having a pair of edges spaced apart a predetermined distance which define a slot which receives a distal end of the strip of material; and a handle guide carrier onto which the first and second handle portions are mounted for longitudinal and rotational movement such that rotation of the second handle portion permits the strip of material to be wound about the tool arm to thereby craft the bead and longitudinal movement of the second handle portion permits the bead to be ejected from the tool arm.

In accordance with embodiments, a bead roller is provided and adapted to craft a bead from a strip of material, the bead roller including at least one of the following: a handle having a gripping surface, the handle including a first handle portion having a first diameter; and a second handle portion having a first section with a second diameter which is less than the first diameter and a second section with a third diameter which is equal to the first diameter, the second handle portion being connected with the first handle portion such that the first handle and the second handle are configured to rotate independently relative to each other; a tool arm axially extending from the first section of the second handle portion and having a fourth diameter which is less than the second diameter, and a pair of edges spaced apart a predetermined distance which define a slot which receives a distal end of the strip of material; and a handle guide carrier onto which the first and second handle portions are mounted for longitudinal and rotational movement such that rotation of the second handle portion permits the strip of material to be wound about the tool arm to thereby craft the bead and longitudinal movement of the second handle portion permits the bead to be ejected from the tool arm.

In accordance with embodiments, a bead roller is provided and adapted to craft a bead from a strip of material, the bead roller including at least one of the following: a handle guide carrier; a first handle portion mounted for rotational movement on the handle guide carrier; a second handle portion mounted for rotational and longitudinal movement on the handle guide carrier; a tool arm axially extending from the second handle portion and having first and second spaced apart opposing edges which define a slot which receives and engages a distal end of the strip of material. The second handle portion is configured for rotation simultaneously with the tool arm about the handle guide carrier and independently of the first handle portion.

In accordance with embodiments, a bead roller is provided and adapted to craft a bead from a strip of material, the bead roller including at least one of the following: a handle guide carrier; a handle mounted on the handle guide carrier between a first position in which the handle has rotational movement about the handle guide carrier to thereby permit the strip of material to be wound about the tool arm to craft a bead, and a second position in which the handle has longitudinal movement on the handle guide carrier to thereby permit the strip of material to be ejected from the tool arm; and a tool arm axially extending from the handle and configured for simultaneous rotation with the handle, said tool arm having a pair of opposing edges spaced apart a predetermined distance which define a slot which receives a distal end of the strip of material.

In accordance with embodiments, a bead roller is provided and adapted to craft a bead from a strip of material, the bead roller including at least one of the following: a handle guide carrier; a base handle portion mounted for rotational movement on the handle guide carrier, and having a first diameter;

an intermediate handle portion having a second diameter which is equal to the first diameter; a distal handle portion mounted for rotational and longitudinal movement on the handle guide carrier, and having a third diameter which is less than the first and second diameters; and a tool arm axially extending from the distal handle portion and having a fourth diameter which is less than the first, second and third diameters, the tool arm having a pair of spaced apart opposing edges which define a slot which receives a distal end of the strip of material. Rotation of at least the distal handle portion permits the strip of material to be wound about the tool arm to thereby craft the bead and longitudinal movement of the distal handle portion permits the bead to be ejected from the tool arm.

In accordance with embodiments, a bead can be crafted quickly and efficiently from a strip of material using the craft bead roller as follows. The strip of material can be inserted into the tool arm slot. A first manipulation of the bead roller by the user is done via rotating at least one of the first and second handle portions while also reducing the tension on the opposite, non-inserted end of the strip of material. Once the strip of material is at a predetermined remaining diameter, rotation of the bead roller is then stopped. An adhesive is then applied to the bottom surface of the predetermined remaining length of the strip of material. A second manipulation of the bead roller by rotating at least one of the first and second handle portions while simultaneously applying the adhesive to the top surface of the bead of material. The bead of material may then be ejected from the tool arm be manipulating the handle longitudinally such that it shrouds the tool arm.

DESCRIPTION OF EMBODIMENTS

As illustrated in example FIGS. 1-7, in accordance with embodiments, bead roller 10 is provided having an ergonomic design permitting a user to craft one or more beads from a strip of strip of material while also ejecting the bead from the bead roller 10 upon completion of a beading sequence. While the bead roller 10 is described here for use with strips of material composed of paper, a polymer, cloth, a composite and the like, embodiments are not limited thereto.

Figure 1A:
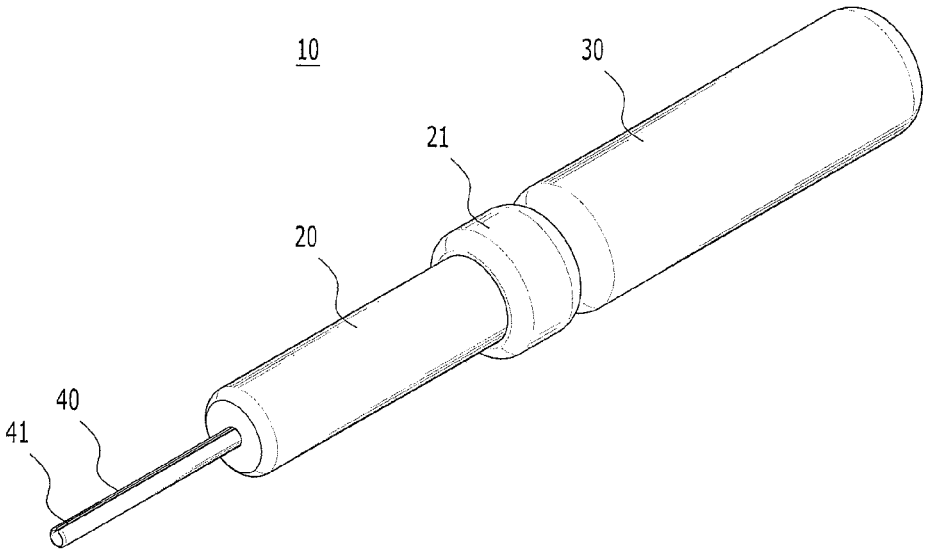
FIGS. 1A and 1B illustrate perspective views of a craft bead roller, in accordance with embodiments.
Figure 1B:
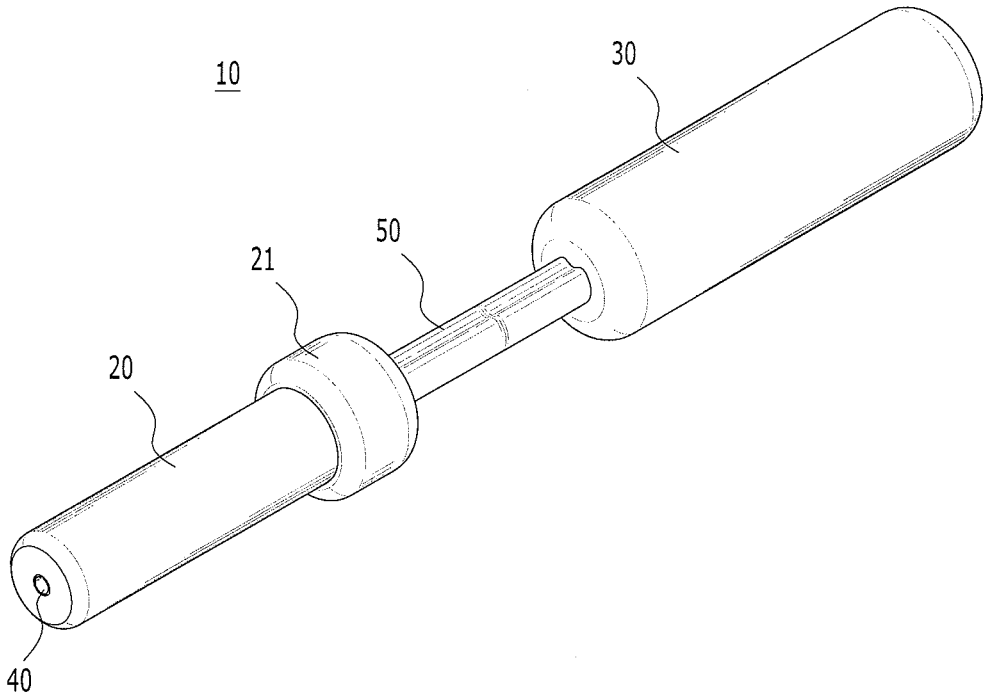
Figure 2:
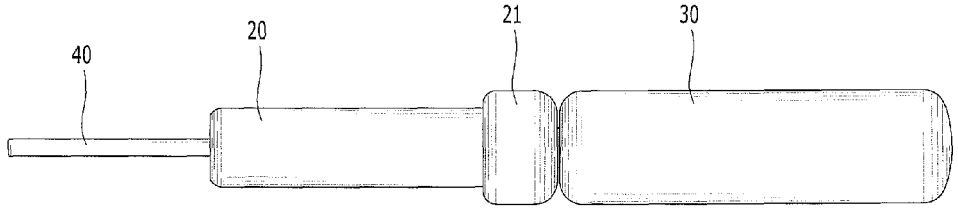
FIGS. 2 and 3 illustrate front and rear plan views of the bead roller of FIG. 1A, in accordance with embodiments.
Figure 3:
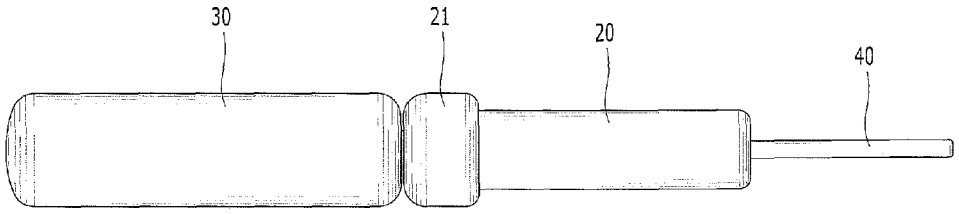

FIG. 1A illustrates the bead roller 10 in a position permitting a user to create one or more beads. FIG. 1B illustrates the bead roller 10 in a position permitting a user to eject one or more beads therefrom after completing a desired bead(s).

As illustrated in example FIGS. 1-3 and 6-7, bead roller 10 may include a handle having bifurcated portions 20, 30, a tool arm 30 which axially extends from a distal end of the handle along a longitudinal axis thereof and which receives the strip of material, and a handle guide carrier 50 onto which at least one of the handle portions 20, 30 are mounted for rotational and longitudinal movement. In accordance with embodiments, the second handle portion 20 is mounted on the handle guide carrier 50 such that it moves independently of the first handle portion 30. Alternatively or in combination, the first handle portion 20 is mounted on the handle guide carrier 50 such that it moves independently of the second handle portion 20.

The first handle portion 30 is at a base end of the handle and mounted for rotational movement on the handle guide carrier 50. The second handle portion 20 extends axially along the same longitudinal axis of the first handle portion 30 on the handle guide carrier 50. The second handle portion 20 is mounted for both longitudinal and rotational movement on the handle guide carrier 50. The second handle portion 20 has a first section at a front end thereof and a second section 21 at a base or rear end thereof. The first section of second handle portion 20 has hole or aperture provided therein which is sized to receive the tool arm 30.

Figure 4:
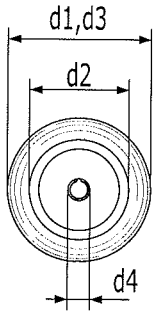
FIGS. 4 and 5 illustrate front and rear views of the bead roller of FIG. 1A, in accordance with embodiments.
Figure 5:
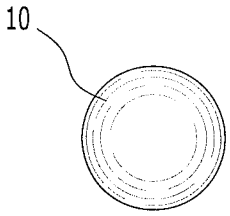
Figure 6:
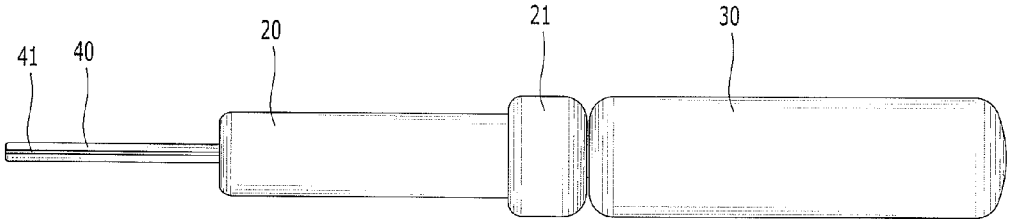
FIGS. 6 and 7 illustrate top and bottom plan views of the bead roller of FIG. 1A, in accordance with embodiments.
Figure 7:
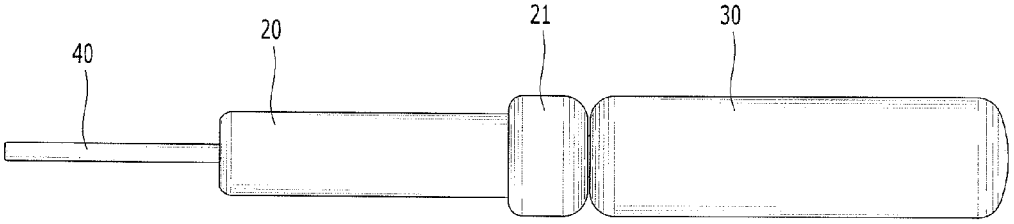

As illustrated in FIG. 4, the handle 20, 30 of bead roller 10 in accordance with embodiments has an ergonomic design that permits a natural and stable grip by a user during a beading sequence. For instance, the first handle portion 30 has a second diameter d2. The second handle portion 20 has a first diameter d1 which is greater than the second diameter d2 of the first handle portion 30. The second section 21 of the second handle portion 20 has a third diameter d3 which is greater than the second diameter d1 of the first handle portion 30 and substantially equal to the first diameter d2 of the second handle portion 20. Although the first handle portion 30 can have a generally uniform diameter, embodiments are not limited thereto. Moreover, the second handle portion 20 can include a first section at a distal portion thereof having a diameter which is less than the diameter of the second section 21 located at a rear portion thereof.

The handle 20, 30 may be composed of one or more lightweight, durable materials. For instance, the handle 20, 30 may be composed of a wood material, polymeric material, ceramic material, composite and any combination thereof. In accordance with embodiments, however, the handle 20, 30 is not limited to these materials and may be composed of any suitable lightweight, durable material. The handle 20, alternatively or in combination, may be composed of a transparent material.

The first handle portion 30 and the second handle portion 20 each have a gripping surface to provide the user with an ergonomic manner of manipulating the roller 10 when crafting a bead. The gripping surface may be composed of a material such as a polymer, metal or wood. Such gripping surface may include providing a polymeric layer which surrounds or otherwise shrouds the entire outer surface of at least one handle section 20, 30. Accordingly, second handle portion 22 may be sized to enable a natural and ergonomically stable hand grip when beading material strip M. Accordingly, the manipulation of bead roller 10 through the rotation of the handle 20, 30 does not produce undue stress and/or cramping on the hands and/or fingers of the user.

The tool arm 40 may axially extend from or is otherwise attached adjacent the hole provided at a distal end of the first section of the second handle portion 20. The tool arm 40 may have an elongated body with a generally circular cross-section and has a fourth diameter d4 which is less than the first diameter d1, the second diameter d2 and the third diameter d3.

In accordance with embodiments, the tool arm 40 includes a pair of spaced apart opposing edges spaced apart a predetermined distance which define a slot 41 which is sized to receive a distal end of the strip of material. Slot 41 may extend along a longitudinal axis of the tool arm 40. Although the slot 41 is illustrated here extending along the entire length of the tool arm 40, embodiments are not limited thereto. For instance, the slot 41 may partially extend along the length of the tool arm 40. In such case, the overall length of tool arm 30, and thus, slot 31, may be 2.5 inches, but is not limited thereto.

The opposing edges provide tool arm 40 with a radius of curvature which enables a distal end portion of a strip of material strip to be received in slot 41 and engage one of edges during a beading sequence. Thus, by engaging one of the edges, the strip of material may be wound about the outer surface of the tool arm 40. The tool arm 40 may be composed of a durable material such as a metal, a polymer, a composite and/or any combination thereof, but is not limited thereto.

In accordance with embodiments, the tool arm 40 may be mounted directly to the handle guide carrier 50 and/or to the second handle portion 20. The tool arm 40 should be mounted, however, in a manner such that it moves in rotational synchrony with the second handle portion 20. The tool arm 40 may be attached, connected or received by front end of the handle guide carrier 50 and/or the second handle portion 20 using any suitable adhesive and/or by any mechanical connection. For instance, the tool arm 40 may be press fit into the hole at a distal end of the second handle portion 20. Such press fit connection may include a suitable adhesive to secure the tool arm 40 to the second handle portion 20 or a sleeve received into the hole of the second handle portion 20 which, in turn, receives the tool arm 40.

In operation, a bead from a strip of material may be crafted manually using the bead roller in accordance with embodiments. For instance, a distal end of the strip of material may be inserted into the slot 41 of the tool arm 40. The user may apply tension to the opposite end of the strip of material. The user may grip the first handle section 30 using one hand while gripping the second handle section 20 using the other hand. Alternatively, the user may use one hand to grip both handle sections 20, 30 while using the other to maintain tension on the distal, non-working end (i.e., the end not received in slot 41) of the strip of material.

The second handle section 20 may then be rotated about the handle guide carrier 50 while keeping the first handle section 30 in a non-moving or otherwise static position. This can be performed while by simultaneously rotating bead roller 10 and reducing tension on the non-working end of the strip of material. Depending upon the overall length of strip of material, such manipulation may include rotating bead roller 10 a plurality of times. The manipulation may cease once the strip of material has obtained a predetermined length or the bead has obtained a predetermined circumference. An adhesive may then be applied to the bottom surface of the predetermined remaining length of the strip of material. A second manipulation of the bead roller 10 may then be performed by rotating the second handle section 30 while simultaneously applying the adhesive to the top surface of the almost formed bead of material. The formed bead may then be ejected from the bead roller 10 by moving the second handle section 30 forward along the handle guide carrier 50 such that it shrouds at least partially the tool arm 40.

In accordance with embodiments, the bead roller permits the manually crafting of one or more beads for a decorative article that does not place undue stress and/or cramping of the fingers and/or hands. The bead roller has a compact size that takes up a minimal amount of storage space. The bead roller is composed of materials such that it may be manufactured at a low overall cost. Due to its overall design, the bead roller permits the manually crafting of one or more beads for a decorative article in a reduced amount of time. The bead roller also permits the manually crafting of one or more beads for a decorative article with beads of uniform hole size on a consistent basis. This gives a user the capability of creating several decorative articles in one day.

Although embodiments have been described herein, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A bead roller configured to craft a bead from a strip of material, the bead roller comprising:

a handle guide carrier;

a first handle portion mounted for rotational movement on the handle guide carrier;

a second handle portion mounted for rotational and longitudinal movement on the handle guide carrier;

a tool arm axially extending from the second handle portion and having first and second spaced apart opposing edges which define a slot which receives and engages a distal end of the strip of material;

wherein the second handle portion is configured for rotation simultaneously with the tool arm about the handle guide carrier and independently of the first handle portion.

2. The bead roller of claim 1, wherein the second handle portion is moveable between:

a first position in which the second handle portion has rotational movement about the handle guide carrier to thereby permit the strip of material to be wound about the tool arm to craft a bead; and a second position in which the second handle portion has movement along the longitudinal axis of the handle guide carrier to thereby permit the strip of material to be ejected from the tool arm.

3. The bead roller of claim 2, wherein in the second position the second handle portion completely shrouds the tool arm.

4. The bead roller of claim 1, wherein the first and second handle portions are each composed of a transparent material.

5. The bead roller of claim 1, wherein the first and second handle portions are each composed of at least one of wood, a polymer, a ceramic, a composite and a metallic material.

6. The bead roller of claim 1, wherein the tool arm is composed of at least one of wood, a polymer, a ceramic, a composite and a metallic material.

7. The bead roller of claim 1, wherein the tool arm is mounted such that it moves in rotational synchrony with the second handle portion.

8. The bead roller of claim 1, wherein the second handle portion is mounted on the handle guide carrier such that the second handle portion rotatably and longitudinally moves independently relative to the first handle portion.

9. The bead roller of claim 1, wherein the first handle portion is mounted on the handle guide carrier such that the first handle portion rotatably moves independently relative to the second handle portion.

10. A bead roller adapted to craft a bead from a strip of material, the bead roller comprising:

a handle guide carrier;

a handle mounted on the handle guide carrier capable of moving between a first position in which the handle has rotational movement about the handle guide carrier to thereby permit the strip of material to be wound about the tool arm to craft a bead, and a second position in which the handle has movement along the longitudinal axis of the handle guide carrier to thereby permit the strip of material to be ejected from the tool arm; and a tool arm axially extending from the handle and configured for simultaneous rotation with the handle, said tool arm having a pair of opposing edges spaced apart a predetermined distance which define a slot which receives a distal end of the strip of material.

11. The bead roller of claim 10, wherein the handle is composed of at least one of wood, a polymer, a ceramic, a composite and a metallic material.

12. The bead roller of claim 10, wherein the tool arm is composed of at least one of wood, a polymer, a ceramic, a composite and a metallic material.

13. The bead roller of claim 10, wherein the handle comprises:

a first handle portion having a first diameter; and a second handle portion axially extending from the first handle portion, the second handle having a first section with a second diameter which is less than the first diameter and a second section with a third diameter which is equal to the first diameter, wherein said second handle portion is rotatable in clockwise and counterclockwise directions relative to the first handle portion.

14. The bead roller of claim 13, wherein the tool arm is mounted such that it moves in rotational synchrony with the second handle portion.

15. The bead roller of claim 13, wherein the second handle portion is mounted on the handle guide carrier such that the second handle portion rotatably and longitudinally moves independently relative to the first handle portion.

16. The bead roller of claim 13, wherein the first handle portion is mounted on the handle guide carrier such that the first handle portion rotatably moves independently relative to the second handle portion.

17. A bead roller configured to craft a bead from a strip of material, the bead roller comprising:

a handle guide carrier;

a base handle portion mounted for rotational movement on the handle guide carrier, and having a first diameter;

an intermediate handle portion having a second diameter which is equal to the first diameter;

a distal handle portion mounted for rotational and longitudinal movement on the handle guide carrier, and having a third diameter which is less than the first and second diameters; and a tool arm axially extending from the distal handle portion and having a fourth diameter which is less than the first, second and third diameters, the tool arm having a pair of spaced apart opposing edges which define a slot which receives a distal end of the strip of material, wherein rotation of at least the distal handle portion permits the strip of material to be wound about the tool arm to thereby craft the bead and longitudinal movement of the distal handle portion permits the bead to be ejected from the tool arm.

18. The bead roller of claim 17, wherein the slot extends along the entire length of the tool arm.

19. The bead roller of claim 17, wherein:

the distal handle portion is mounted on the handle guide carrier such that the distal handle portion rotatably and longitudinally moves independently relative to base handle portion;

the intermediate handle portion is mounted on the handle guide carrier such that it moves in synchrony with the distal handle portion; and the tool arm is mounted such that it moves in rotational synchrony with the distal handle portion.

20. The bead roller of claim 17, wherein:

the base handle portion rotatably moves independently relative to intermediate and distal handle portions;

the intermediate handle portion moves in synchrony with the distal handle portion; and the tool arm moves in rotational synchrony with the distal handle portion.

* * * * *